United States Patent [19]

Vanderminden

[11] 4,252,367

[45] Feb. 24, 1981

[54] SLING CHAIR

[75] Inventor: Robert D. Vanderminden, Granville, N.Y.

[73] Assignee: The Telescope Folding Furniture Co., Inc., Granville, N.Y.

[21] Appl. No.: 48,833

[22] Filed: Jun. 15, 1979

[51] Int. Cl.[3] ..... A47C 4/30

[52] U.S. Cl. ..... 297/23; 297/441; 297/457

[58] Field of Search ..... 297/19-22, 297/23, 441, 457, 452

[56] References Cited

U.S. PATENT DOCUMENTS

| | | | |
|---|---|---|---|
| 647,929 | 4/1900 | Allen | 297/457 |
| 2,543,543 | 2/1951 | Gomes et al. | 297/20 |
| 2,547,559 | 4/1951 | Briggs | 297/457 X |
| 2,679,287 | 5/1954 | Eiseman | 297/419 X |
| 3,328,085 | 6/1967 | Schwartz et al. | 297/452 |
| 3,523,710 | 8/1970 | Barecki et al. | 297/457 X |
| 3,967,852 | 7/1976 | Eiselt et al. | 297/452 |

FOREIGN PATENT DOCUMENTS

| | | | |
|---|---|---|---|
| 395167 | 5/1924 | Fed. Rep. of Germany | 297/23 |

*Primary Examiner*—Francis K. Zugel
*Attorney, Agent, or Firm*—Kenyon & Kenyon

[57] ABSTRACT

The sling is secured in a front cross-bar which is pivotally mounted in a suspended manner at the front of the chair to accommodate the various positions of an occupant. A flexible plate is also secured to the front cross-bar under the sling to increase the contact area with an occupant's legs and thus spread the load.

6 Claims, 4 Drawing Figures

SLING CHAIR

This invention relates to a sling chair. More particularly, this invention relates to an adjustable sling chair having means to spread the weight of an occupant's weight over a front cross-bar.

As is known, sling chairs are generally constructed with a collapsible support frame and a sling of fabric which is supported at two ends within the support frame in order to form a seat for an occupant. In many cases, these sling chairs have been adjustable so that different positions can be taken up by an occupant. Generally, these sling chairs have had a cross-bar at the front to which the front end of the sling is attached. However, after extended periods of time, this cross-bar tends to cut off circulation in the legs of the occupant causing numbness. In some cases, it has also been known to mount the front cross-bar in a pivotal manner on the support frame so as to adjust to the position of an occupant.

It is an object of this invention to spread out the load of an occupant's legs on the front cross-bar of a sling chair.

It is another object of the invention to prevent the cutting off of circulation in the legs of an occupant of a sling chair.

Briefly, the invention provides a sling chair which is comprised of a collapsible support frame having a cross-bar at a front thereof, a sling secured in the support frame with one end fixed to the cross-bar, means for suspending the cross-bar within the frame in pivotal relation and a flexible plate secured to the cross-bar to extend under the sling towards the rear of the chair. The flexible plate spreads the point of contact of the cross-bar over a relatively wide area of the legs of an occupant and may be made of plastic or other suitable flexible material. By spreading the point of contact of the occupant's legs over a wider area, the possibility that the circulation in the occupant's legs would be cut off is reduced to a minimum along with the fatigue which might otherwise be caused by the bar.

The pivoting action of the cross-bar allows the bar and the flexible sheet to remain parallel with the occupant's legs regardless of the position of the occupant in the chair.

These and other objects and advantages of the invention will become more apparent from the following detailed description and appended claims taken in conjunction with the accompanying drawings in which:

Figure 1:
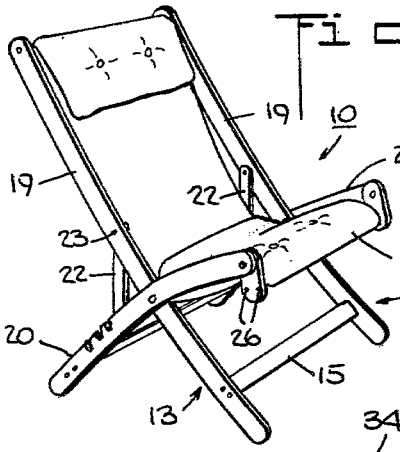
FIG. 1 illustrates a perspective front view of a sling chair according to the invention.

Referring to FIG. 1, the sling chair 10 is constructed of a collapsible support frame 11 and a sling 12 which is secured within the support frame 11.

The collapsible support frame 11 has a pair of crossed leg frames 13 secured together by a plurality of cross-bars (i.e. four cross-bars) 14, 15, 16, 17. Each leg frame 13 includes a pair of legs 19, 20 which are disposed in in hinged relation at intermediate points via a hinge pin 21. As shown in FIG. 1, each of the legs 19, 20 is of curvilinear shape. The hinge pin 21 may be in the form of a rivet which is passed through the two legs 19, 20 at intermediate points.

Figure 3:
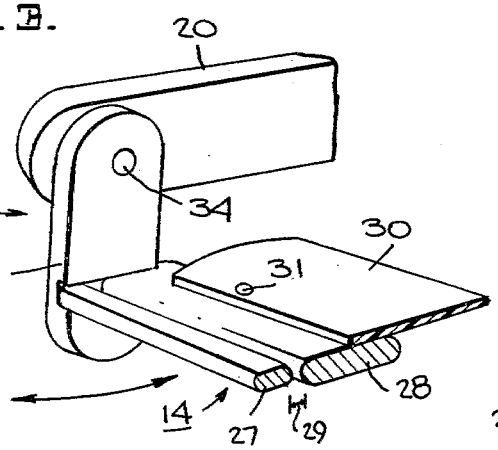
FIG. 3 illustrates a cross-sectional view of the sling chair of FIG. 1 in a fully reclined position.

As indicated in FIG. 1, an adjusting means is provided for fixing the legs 19, 20 in one of a plurality of positions relative to each other. This adjusting means includes a pair of struts 22 which are pivoted via pins 23 to the legs 19 and a cross-bar 24 which is secured in the free ends of the struts 22 and extends across the rear of the chair 10. The cross-bar 24 is sized to fit into one pair of a plurality of pairs of slots 25 in the rear portions of the legs 20. When the cross-bar 24 is located in the upper pair of slots 25, the chair 10 is in an upright position (FIG. 3). When placed in the lowest pair of slots 25, the chair 10 is in an upright position (FIG. 3). When placed in the lowest pair of slots 25, the chair 10 is in a fully reclined position (FIG. 3).

The cross-bars 15, 16 are of any suitable shape, for example, of relatively flat rectangular cross-sectional shape, and are secured to the legs 19, 20 in any suitable fashion, for example, by pairs of threaded screws 26.

Figure 4:
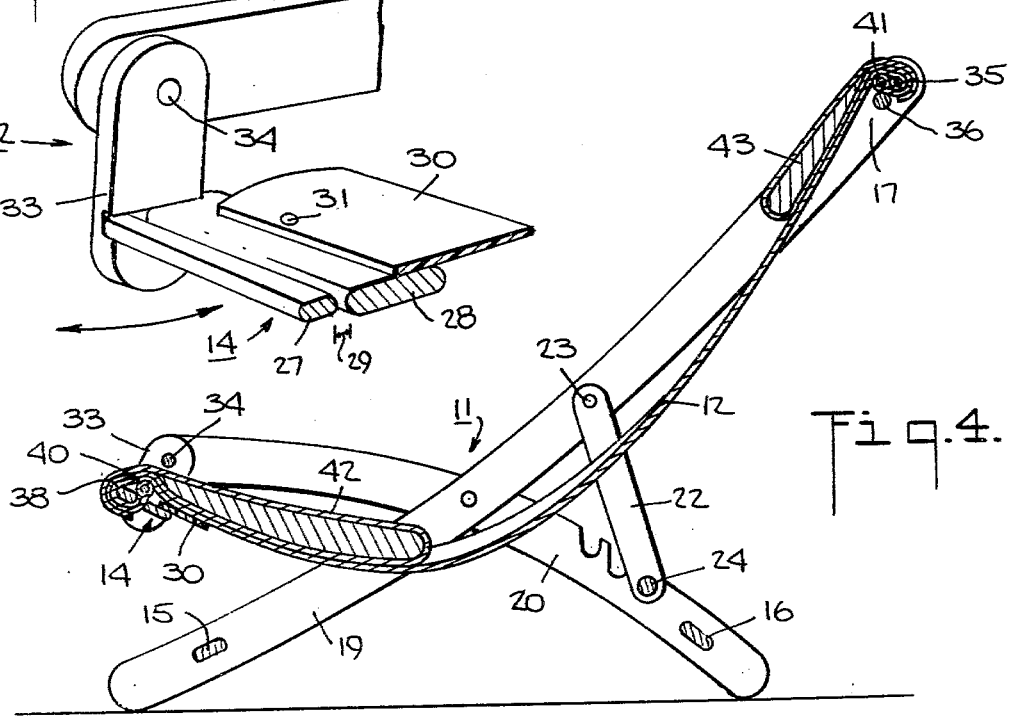
FIG. 4 illustrates a partial view of a flexible plate for spreading the load of an occupant in accordance with the invention.

The front cross-bar 14, is for example, of flat shape and, as shown in FIG. 4, is formed of a pair of parallel spaced apart pieces 27, 28 which define a gap 29 to receive one end of the sling 12. Each piece 27, 28 is of a generally flat rectangular cross-sectional shape with the rearmost piece 28, being of greater lateral extent. In addition, a flexible plate 30 is secured in cantilever relation to the cross-bar 14, i.e. to the rearmost piece 28, for example via screws 31 or other suitable fastening means, and extends under the sling 12 towards the rear of the chair 10. The plate 30 is made of a flexible sheet of plastic, for example, linear polyethylene, or some other suitable flexible material which is able to flex under the weight of an occupant while spreading the imposed weight over a large area. In the illustrated example, the plate 30 is approximately 20 inches long by 5 inches wide by 0.100 inches thick.

Figure 2:
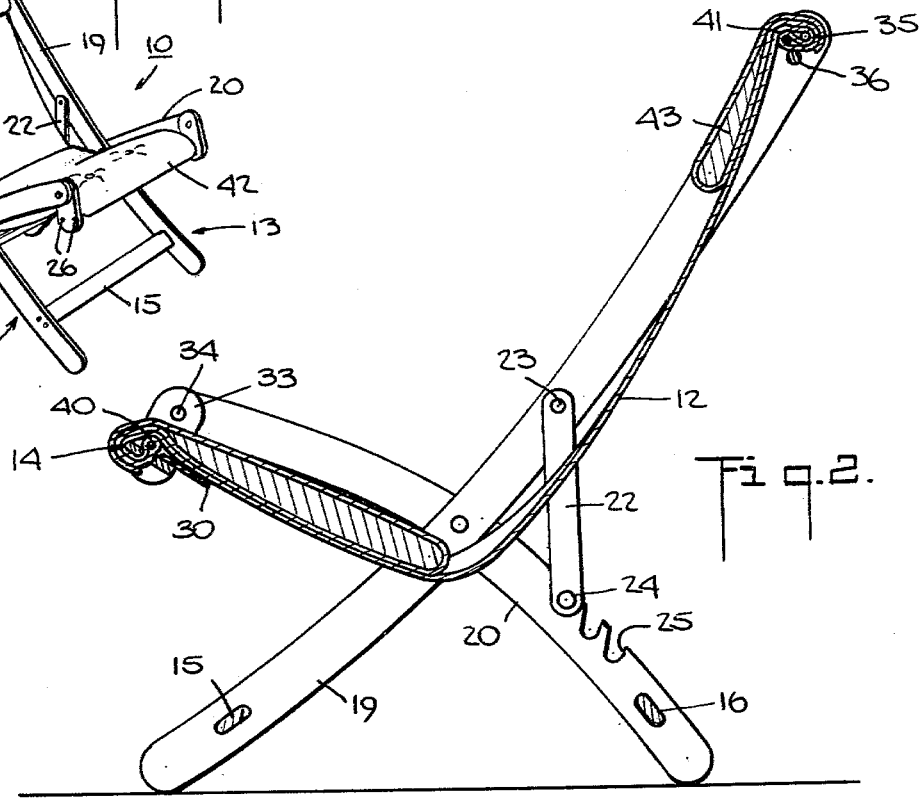
FIG. 2 illustrates a cross-sectional view of the sling chair of FIG. 1 in an upright position.

Referring to FIG. 4, the chair 10 has a means 32 for suspending the front cross-bar 14 within the frame 11 in pivotal relation. This means 32 is in the form of a pair of links 33 each of which is pivotally mounted at an upper end on a respective leg 20 via a pivot pin 32 and fixedly secured at the lower end to a respective end of the front bar 14 i.e. to both pieces 27, 28. As indicated in FIG. 4, the front cross-bar 14 is suspended by the links 33 to hang below the plane of the legs 20 of the frames B. As indicated in FIG. 2, when the sling chair 10 is in the upright position with an occupant (not shown) in place, the front bar 14 and thus the plate 30 swing into a given position relative to a vertical plane. In this position, the legs of an occupant (not shown) of the chair 10 are comfortably supported by contacting the flat front cross-bar 14 and extension plate 30 over a relatively large area. Should the sling chair 10 be moved into the fully reclined position as shown in FIG. 3, the front cross-bar 14 and plate 30 are swung in a counter-clockwise direction, as viewed so as to assume a different position relative to the vertical plane. This position corresponds to the adjusted position of the occupant's legs so that the occupant's legs are still supported over the cross-bar 14 and flat surface of the plate 30. The pivoting action of the cross-bar 14 allows the flat flexible plate 30 to remain parallel with the occupant's legs regardless of the position of the chair 10.

Referring to FIG. 2, the rear cross-bar 17 is composed of two pieces, for example two rods 35, 36 which define a gap 37 therebetween to receive the sling 12.

Referring to FIGS. 1 and 2, the sling 13 is secured to the front cross-bar 14 and to the rear cross-bar 17. To this end, the sling 13 is formed near each end with a loop 38, 39 which extends through the gap 29, 37 in the respective cross-bar 14, 17 while a rod 40, 41 of larger size than the gap 29, 37 is disposed in the respective loop 38, 39 in order to fix the sling 12 to the respective cross-bar 14, 17.

In addition, a cushion 42 is secured to one end of the sling 12 while a pillow 43 is secured to the opposite end. The cushion 42 and pillow 43 are secured to the sling 12 so that each can be placed in the positions shown (FIG. 3) or folded back to hang downwardly behind the chair 10, in the case of the pillow 43, and, in the case of the cushion 42, to fold over the front edge of the chair 10.

The chair 10 can be made of any suitable materials. For example, the support frame 11 may be made entirely of wood and the sling 12 can be made of fabric such as a canvas with an esthetically pleasing appearance.

The invention thus provides a sling chair with a simple means of spreading the weight of an occupant's legs over a wide area in a manner so as to eliminate fatigue as well as numbness in the legs of an occupant.

What is claimed is:

1. A sling chair comprising a collapsible support frame having a cross bar at a front thereof;

a sling secured in said support frame and having one end fixed to said cross bar;

means for suspending said cross bar within said frame in pivotal relation; and a flexible plate secured to said cross bar and extending under said sling towards a rear of the chair to spread the point of contact of said cross bar over a relatively wide area of the legs of an occupant.

2. A sling chair comprising a support frame having a pair of crossed leg frames and a plurality of cross bars securing said leg frames together;

a sling secured in said support frame with one end secured to a front cross bar of said cross bars and a second end secured to a rear cross bar of said cross bars;

means for suspending said front cross bar within said frame in pivotal relation, said means including a pair of links, each said link being pivotally mounted on a respective one of said leg frames and secured to a respective end of said front bar; and a flexible plate secured to said front cross bar in cantilever relation and extending under said sling.

3. A sling chair as set forth in claim 2 wherein said front cross bar is flat.

4. A sling chair as set forth in claim 2 wherein said plate is made of plastic.

5. A sling chair as set forth in claim 2 wherein said plate is approximately five inches wide and 0.100 inches thick.

6. A sling chair as set forth in claim 2 wherein said front cross bar includes a pair of parallel spaced apart pieces defining a gap therebetween, said sling includes a loop extending through said gap and a rod disposed in said loop to fix said sling to said front cross bar, and said plate is secured to an upper surface of the rear most piece of said pieces of said cross-bar.

* * * * *

UNITED STATES PATENT AND TRADEMARK OFFICE

CERTIFICATE OF CORRECTION

PATENT NO. : 4,252,367

DATED : February 24, 1981

INVENTOR(S) : Robert D. Vanderminden

It is certified that error appears in the above—identified patent and that said Letters Patent is hereby corrected as shown below:

Column 2, line 14, change "3" to --2--

Line 14 to 15, cancel "when placed in the lowest pair of slots 25, the chair 10 is in an upright position (Fig. 3)."

Line 17, change "3" to --4--

Signed and Sealed this

*Thirtieth* Day of *June 1981*

[SEAL]

*Attest:*

RENE D. TEGTMEYER

*Attesting Officer*

*Acting Commissioner of Patents and Trademarks*